United States Patent [19]

Masahiro

[11] Patent Number: 4,483,578

[45] Date of Patent: Nov. 20, 1984

[54] CONNECTOR WITH LOCKING MECHANISM

[75] Inventor: Tazawa Masahiro, Tokyo, Japan

[73] Assignee: Showa Musen Kogyo Kabushiki Kaisha, Tokyo, Japan

[21] Appl. No.: 421,129

[22] Filed: Sep. 22, 1982

[30] Foreign Application Priority Data

Jan. 19, 1982 [JP] Japan ..... 57-4579[U]

[51] Int. Cl.[3] ..... H01R 13/62

[52] U.S. Cl. ..... 339/75 MP; 339/95 D; 339/176 MP

[58] Field of Search ..... 339/75 MP, 75 R, 75 M, 339/74 R, 176 MP, 95 D

[56] References Cited

U.S. PATENT DOCUMENTS

| | | | |
|---|---|---|---|
| 2,968,016 | 1/1961 | Angele | 339/75 MP |
| 3,871,733 | 3/1975 | Praeger et al. | 339/176 MP |
| 4,105,276 | 8/1978 | Miller | 339/95 D |
| 4,252,392 | 2/1981 | Whitman Jr. | 339/74 R |
| 4,261,631 | 4/1981 | Guilcher et al. | 339/75 MP |
| 4,288,139 | 9/1981 | Cobaugh et al. | 339/74 R |
| 4,402,563 | 9/1983 | Sinclair | 339/17 CF |

*Primary Examiner*—John McQuade
*Assistant Examiner*—Thomas M. Kline
*Attorney, Agent, or Firm*—Koda and Androlia

[57] ABSTRACT

A connector with a locking mechanism in which a housing includes a pair of side walls one of which is resilient and a pair of end walls and is provided with an inlet for a flexible print circuit board at one end wall defined by the side walls, a plurality of contact springs each having a pair of opposing legs are disposed within said housing in spaced relationship in the longitudinal direction of the housing and an operation lever is rotatably mounted on said ends walls of the housing and includes a pair of opposing operation legs and an arm connected at the opposite ends to one ends of said operation legs at right angles thereto and having a center outwardly bulging portion.

2 Claims, 7 Drawing Figures

CONNECTOR WITH LOCKING MECHANISM

BACKGROUND OF THE INVENTION

This invention relates to a connector with a locking mechanism for use in connection with a flexible print circuit board.

Hithertofore, a variety of connectors with locking mechanism have been proposed for use in connection with flexible print circuit boards (the flexible print circuit board will be abbreviated as "FPC" hereinafter) and the most common one of the prior art connectors with locking mechanisms is shown in FIGS. 1*a* and 1*b* of the accompanying drawings. In these Figures, reference numeral 1 denotes the housing of the connector, reference numeral 2 denotes contact springs each folded to provide two opposing legs housed in spaced relationship within the connector housing 1 and reference numeral 3 denotes a locking plate pivotally mounted at one end of the connector housing 1. After a FPC has been inserted into the housing 1 to be positioned between the opposing legs of each contact springs, when the locking plate 3 is rotated in the arrow direction A to bias the contact springs against the FPC whereupon the contact springs firmly grip the FPC to lock the same in position under the force applied to the springs by the rotation of the locking plate 3 in the above-mentioned direction. In order to further ensure the locking of the FPC in position, the FPC is provided with a plurality of spaced locking notches (not shown) in suitably spaced positions along one side edge thereof and the locking plate is also provided with a similar number of spaced projections 31 along one side edge thereof in positions corresponding to those of the locking notches in the FPC for engaging in the notches when the FPC is locked in a predetermined position.

However, the prior art connector referred to hereinabove can not be used in a device in which a space sufficient for allowing the locking plate 3 to rotate in the arrow direction A is not available. In addition, the above-mentioned connector with the locking mechanism can not meet the present trend in the art which calls for smaller and smaller connectors. Furthermore, since the locking plate 3 is usually produced by the moulding process, the connector provided with such a locking plate is inevitably expensive.

SUMMARY OF THE INVENTION

Therefore, the present invention has been developed to eliminate the disadvantages inherent in the prior art connector with the locking mechanism referred to hereinabove.

The purpose of the present invention is to provide a less expensive connector with a locking mechanism which includes a locking lever for locking a FPC made by bending a length of piano wire in a simple manner and which requires a very limited space for the operation of the locking mechanism.

According to the present invention, there has been provided a connector with a locking mechanism which comprises a connector housing including a pair of opposing side walls one of which is resilient and a pair of opposing end walls and provided in one of said end walls with an inlet for a flexible print circuit board; a plurality of spaced contact springs disposed within said housing; and a locking lever rotatably mounted on said end walls of the connector housing adjacent to said resilient side wall of the connector, said locking lever is in the shape of a substantially U including a pair of opposite and spaced operation legs and an arm connected at the opposite ends to one ends of said operation portions at right angles thereto and including a center bulging portion adapted to abut against said resilient side wall of the housing in the locking position of said lever to thereby bias the resilient side wall against said contact springs.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

BRIEF DESCRIPTION OF THE DRAWINGS

The present invention will be now described referring to FIGS. 2 through 4. FIG. 2*a* shows the connector in the unlocked position and FIG. 2*b* shows the connector in the locked position, respectively. FIG. 3 shows one form of the locking lever employed in the connector of the invention and FIGS. 4*a* and 4*b* show the operation of the connector. FIG. 4*a* shows the unlocking of the connector and FIG. 4*b* shows the locking of the connector, respectively.

In FIGS. 2*a*, 2*b*, 4*a* and 4*b*, reference numeral 4 generally shows the housing of the connector, reference numeral 5 generally denotes contact springs each folded to provide a pair of opposing legs housed within the connector housing 4 and reference numeral 6 generally denotes the locking lever. The connector housing 4 includes a print circuit board inlet 41 defined between a pair of opposing side walls 42, 43 at one end of the housing and one of the side walls 42 is formed resilient for the purpose to be described hereinafter. Since the contact springs 5 are identical, only one of the springs will be described in detail with the understanding that the same is equally applicable to the other contact springs. In the unlocked position of the connector, the resilient side wall 42 and one of the legs 51 of the contact spring 5 leave a clearance D therebetween. The other leg 52 of the contact spring 5 is always in close contact with the rigid side wall 43 of the connector housing 4. The folded contact spring 5 further includes a terminal portion 53 formed by portions of the opposing legs 51, 52 which abut against each other and the terminal portion 53 projects out of the connector housing 4 through the bottom 44 of the housing. The locking lever 6 has a substantially U-shape and includes a pair of opposing operation legs 61, 61 and an arm orientated at right angles to the legs and connecting the one ends of the pair of legs 61, 61 together. The locking lever 6 is formed by bending a length of piano wire into the substantially U-shaped configuration. The arm of the locking lever 6 comprises a center outwardly bulging portion 62 and a pair of base portions 63, 63 integrally connected to the opposite ends of the center bulging portion 62. The locking lever 6 is rotatably mounted on the opposite end walls (not shown) of the connector housing 4 adjacent to the resilient side wall 42 of the housing by means of the base portions 63, 63 with the center bulging portion 62 biasing the resilient side wall 42 of the connector housing 4.

Figure 1A:
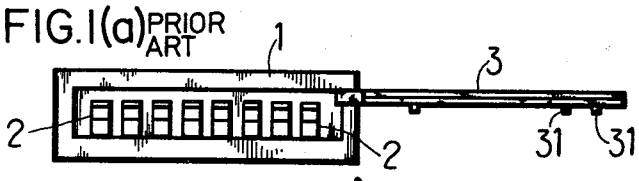
FIG. 1(a) PRIOR ART
FIG. 1*a* is a side elevational view of a prior art connector with a locking mechanism.
Figure 1B:
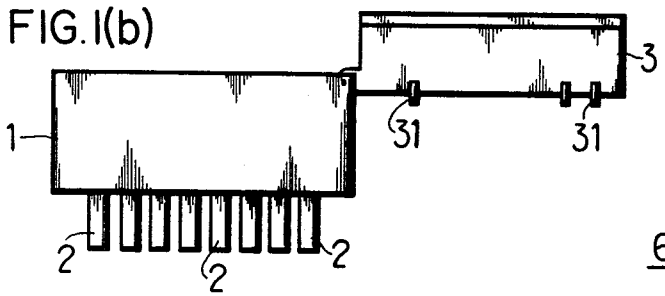
FIG. 1*b* is a plan view of said connector as shown in FIG. 1*a;*
Figure 2A:
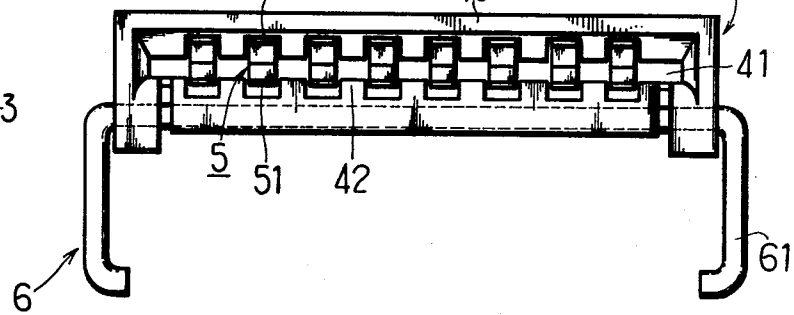
FIG. 2*a* is a plan view of the preferred embodiment of connector with a locking mechanism constructed in accordance with the principle of the present invention showing the connector in the unlocked position.
Figure 2B:
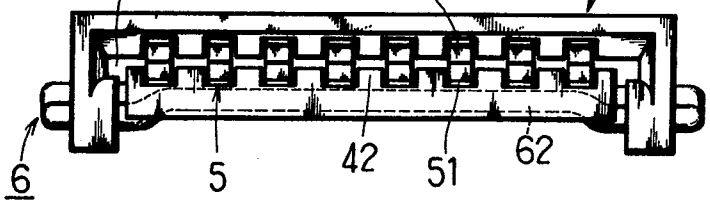
FIG. 2*b* is similar to FIG. 2*a*, but shows said connector in the locked position.
Figure 3:
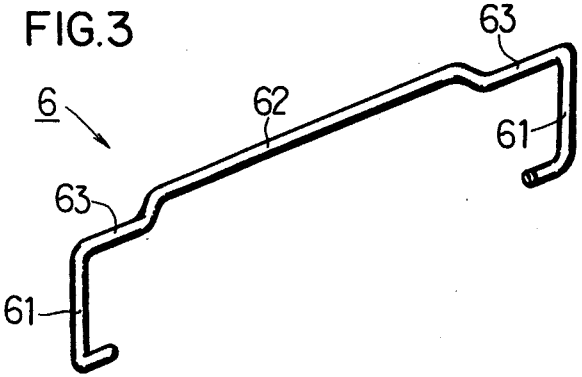
FIG. 3 is a perspective view of the operation lever employed in said connector as shown in FIGS. 2*a* and 2*b*.
Figure 4B:
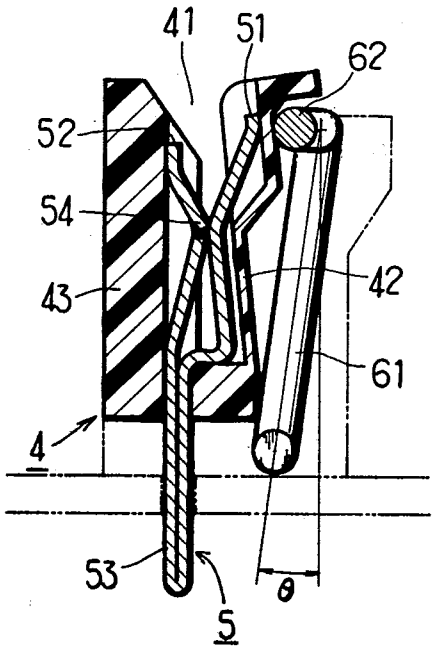
FIG. 4*a* and 4*b* are cross-sectional views explaining the operation of the locking mechanism of the connector as shown in FIGS. 2*a* and 2*b*.
Figure 4A:
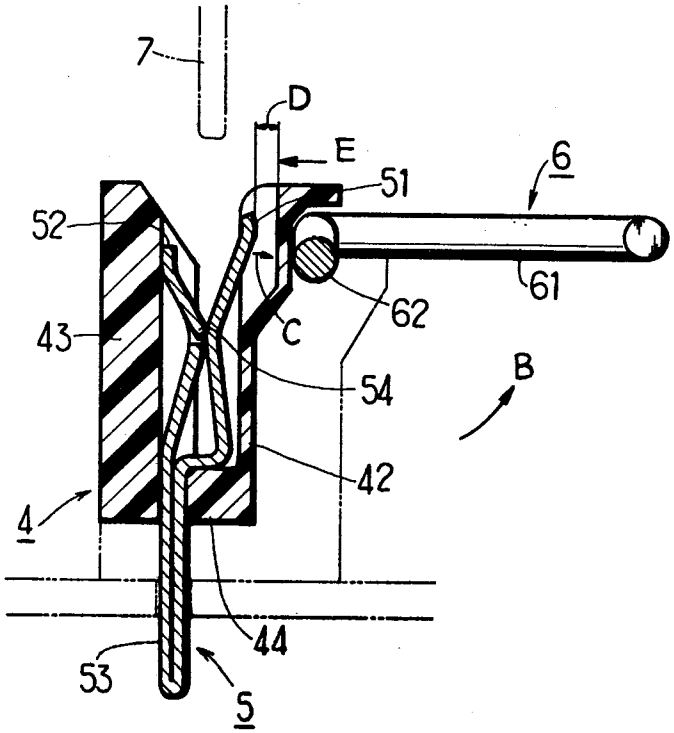

In the operation, with the connector held in the locked position as shown in FIG. 4*b* the operation legs 61, 61 are rotated in the arrow direction B as seen in FIG. 4*a* to unlock the connector whereupon the center bulging portion 62 of the lever 6 is disengaged from the resilient side wall 42 of the connector housing 4 to create the clearance D between the resilient side wall 42 and the opposing leg 51 of the spring 5. Then, the FPC 7 is inserted into the connector housing 4 via the inlet 41 and further forced into between the opposing legs 51, 52 of the spring 5 to bias the leg 51 in the arrow direction C so that the FPC 7 can be fully positioned within the connector housing 4.

Thereafter, the operation legs 61, 61 of the locking lever 6 are rotated in the direction opposite from the arrow direction B to lock the connector whereupon the bulging portion 62 of the lever 6 abuts against the resilient side wall 42 of the connector housing 4 to bias the side wall 42 in the arrow direction E which in turn urges the leg 51 against the opposing leg 52 whereby the FPC 7 is gripped between the spring legs 51, 52 under a high force and the connector is positively locked to prevent the FPC 7 coming off the spring legs inadvertently. In order to ensure the locking, the spring leg 52 is cut and bent inwardly in an intermediate position between the opposite ends thereof to provide a catch 54 which is adapted to bite into the FPC 7 when the FPC 7 tends to come off the pinch between the spring legs.

In the locked position, the operation legs 61, 61 of the locking lever 6 is orientated at an angel $\theta$ with respect to the vertical and the center bulging portion 62 of the lever 6 is also orientated at the angle $\theta$ with respect to the vertical whereby the FPC 7 is prevented from being unlocked inadvertently.

As clear from the foregoing description in connection with the preferred embodiment of the invention, the connector with a locking mechanism comprises the connector housing having the opposing inlet defining side walls one of which is resilient, the contact springs disposed within the connector housing and each including the arm with the center bulging portion and the pair of operation legs at right angles to the arm, said bulging portion being adapted to abut against the resilient side wall of the connector housing to bias the resilient wall against the contact springs, and the locking lever rotatably mounted on the connector housing and thus, the present invention provides a less expensive connector with a locking mechanism which requires only a limited space for operation.

While only one embodiment of the invention has been shown and described in detail, it will be understood that the same is for illustration purpose only and not to be taken as a definition of the invention, reference being had for the purpose to the appended claims.

What is claimed is:

1. A connector with a locking mechanism comprising:

a housing including a pair of opposing side walls one of which is resilient and a pair of opposing end walls provided at the ends of said side walls to define an inlet for a flexible printed circuit board which is to be received between said opposing side walls;

a plurality of contact springs disposed within said housing in spaced relationship in a longitudinal direction of the housing, said contact springs being bent to provide first and second opposing legs with said first legs being always in contact with the non-resileint side wall of said housing and with said second legs being spaced from said resilient side wall of said housing in the unlocked position of said connector and being adapted to be abutted by the resilient side wall of the housing in the locked position of said connector; and a locking lever formed by bending a length of wire and being rotatably mounted on said end walls of the housing adjacent to said resilient side wall, said lever having a substantially U-shaped configuration, the opposing legs of said U-shaped lever comprising a pair of opposing operation legs and an arm connected at its opposite ends to one end of said operation legs at right angles to the legs and including a center eccentric portion adapted to abut against said resilient side wall which in turn biases said contact springs in the locking position of said connector.

2. The connector with a locking mechanism as set forth in claim 1 in which said first leg of the contact spring is provided with a catch for positively locking a flexible print circuit board when said board is gripped by the opposing legs of the contact spring.

* * * * *